US005440601A

United States Patent [19]

Kühfuss

[11] Patent Number: 5,440,601

[45] Date of Patent: Aug. 8, 1995

[54] COUNTING STATION FOR COUNTING THE NOTES OF VALUE, IN PARTICULAR BANKNOTES, OF A BANDEROLED PACK OF NOTES

[75] Inventor: Runwalt Kühfuss, Lausanne, Switzerland

[73] Assignee: De La Rue Giori S.A., Lausanne, Switzerland

[21] Appl. No.: 205,571

[22] Filed: Mar. 3, 1994

[30] Foreign Application Priority Data

Mar. 11, 1993 [CH] Switzerland ..... 734/93

[51] Int. Cl.[6] ..... G06M 7/06

[52] U.S. Cl. ..... 377/8

[58] Field of Search ..... 377/8

[56] References Cited

U.S. PATENT DOCUMENTS

| | | | |
|---|---|---|---|
| 2,847,810 | 8/1958 | Davey et al. | 53/590 |
| 3,214,096 | 10/1965 | Buchholz et al. | 235/98 R |
| 4,056,193 | 11/1977 | Yoshida | 377/8 |
| 4,532,421 | 7/1985 | Sasaoka et al. | 377/8 |

FOREIGN PATENT DOCUMENTS

| | | |
|---|---|---|
| 239888 | 10/1911 | Austria . |
| 0263712 | 4/1988 | European Pat. Off. . |
| 0335631 | 10/1989 | European Pat. Off. . |
| 1774980 | 3/1973 | Germany . |
| 3333521 | 4/1985 | Germany . |
| 787624 | 12/1957 | United Kingdom . |

*Primary Examiner*—John S. Heyman

*Attorney, Agent, or Firm*—Kane, Dalsimer, Sullivan, Kurucz, Levy, Eisele & Richard

[57] ABSTRACT

The counting station has a transporting section (2*b*), on which the banderoled packs of notes (P) are moved at certain intervals uniformally past the rotating counting disk (1*a*, 1*a*') of a note-counting device (1, 1') fixedly installed on this transporting section. Downstream of the transporting section (2*b*) there is a diverter (9) with two further transporting sections (2*c*, 2*d*), of which one receives packs of notes having the correct number of notes of value and the other receives packs of notes having the incorrect number of notes of value.

11 Claims, 5 Drawing Sheets

FIG.10
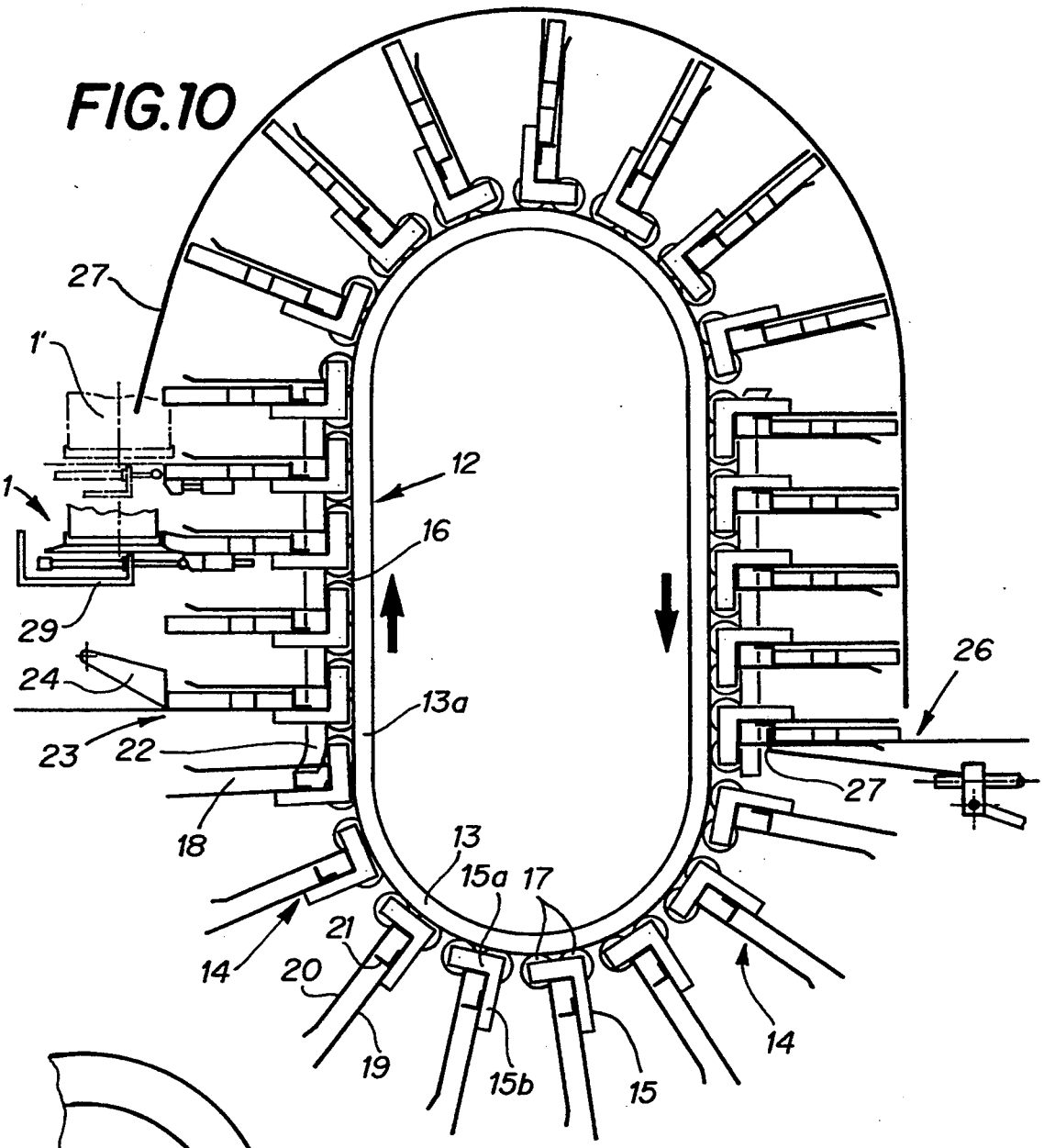
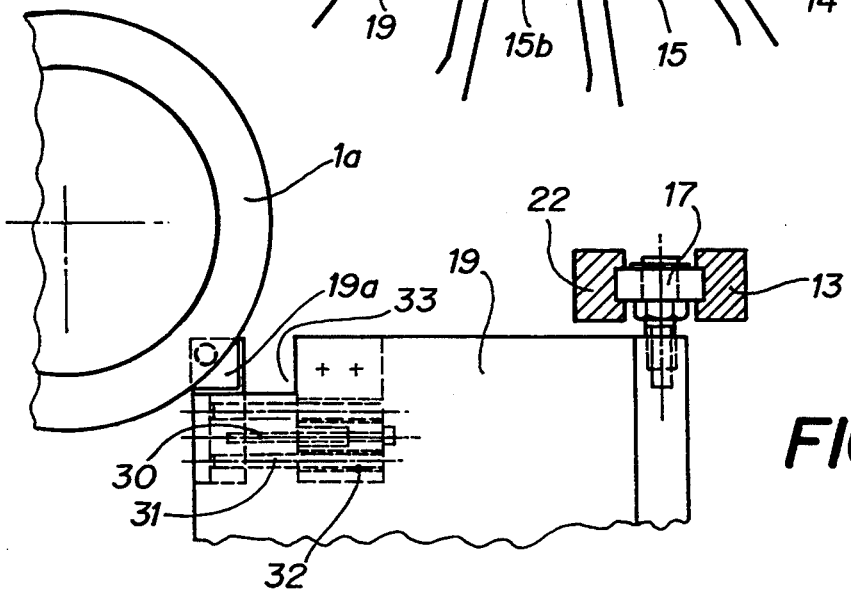
FIG. 11

COUNTING STATION FOR COUNTING THE NOTES OF VALUE, IN PARTICULAR BANKNOTES, OF A BANDEROLED PACK OF NOTES

FIELD OF THE INVENTION

The invention relates to a counting station for counting the notes of value, in particular banknotes, of a banderoled pack of notes in a final processing apparatus for freshly printed notes of value, having at least one automatically operating counting device with rotating counting disk.

PRIOR ART

Counting stations having automatically operating counting devices which have a rotating counting disk are already known (for example U.S. Pat. No. 3,436,529). With these known counting devices, the counting of the notes of value of a pack of notes takes place by the counting device moving with its rotating counting disk uniformally past the fixed or firmly held pack of notes, the counting disk engaging in a corner region of the pack of notes and, upon its rotation, slightly bending over the corner of each note of value while applying suction and moving it to the other side of the counting disk, so that the rotating counting disk as it were leafs through the entire pack of notes. Counting devices of this type are on the market under the tradename "Sheetmaster", produced by the British company DE LA RUE Instruments, London. After ending the counting of a pack of notes, the latter has to be removed from the counting device, the following pack of notes has to be brought into the correct counting position and the counting device has to be moved back into its starting position. These operations required for the counting of successive packs of notes are laborious and time-consuming. The disadvantages of this are particularly evident in the final processing of freshly printed notes of value, in particular banknotes.

At the end of a processing apparatus for banknotes, generally banderoled packs of 1000 banknotes in each case are counted before these packs are then sealed in plastic. Each pack generally contains 10 banderoled bundles of banknotes of 100 banknotes each. The counting operation is of great significance, since of course the number of 1000 banknotes per pack must be absolutely ensured. Built into the processing apparatuses available on the market are hitherto customary banknote counting devices, as mentioned above, which are modified only slightly for installation in the transfer line. This means that in a fully automatic transfer line there is installed a counting device which is actually intended for manual charging. This transfer line uses mechanical means to replace in a manner of speaking the movement of the hand which feeds the pack, holds it firmly during the counting operation and removes it after the counting operation. In the case of this hitherto customary arrangement, the relationship between the secondary times and main time (that is for the actual counting operation) is approximately 50% to 50%, so that at least half of the time required altogether for the operation thus has to be expended for secondary times, that is to say for the feeding and adjusting of the pack, for its removal after the counting operation and for the return of the counting device.

With the high output of modern processing apparatuses, which can process up to 480,000 banknotes per hour, the time available for the counting operation is, for example, 7.5 seconds. Since two processing apparatuses are generally used alternately, 15 seconds are available per counting device and counting operation. This short time forces the designer either to use more counting devices per processing machine, or else to provide very high counting speeds, namely a counting of, for example, 200 banknotes per second. However, such high counting speeds require high technical expenditure and particular technical attention.

FIGS. 1 to 6 diagrammatically illustrate the mode of operation of previously customary counting devices, in which the counting disk is taken vertically from top to bottom through a corner of the pack of notes and counts as it does so, while the pack of notes itself remains stationary.

SUMMARY OF THE INVENTION

The present invention is based on the object of reducing the secondary times hitherto required when counting packs of notes in favor of the main time, that is to say the actual counting time, so that the counting speed of the counting device in a modern processing apparatus of high output does not have to be disproportionately high.

This object is achieved according to the invention by the features specified in the defining part of claim 1.

Thus, by virtue of the counting device with its counting disk being fixedly installed and the packs of notes being constantly moved one after the other past the counting disk, secondary times are suppressed virtually completely, since the packs of notes can of course be fed one after the other in the transporting direction to the counting disk in practice with only very small interruptions, corresponding to the interval between successive packs of notes.

Expedient developments of the invention emerge from the dependent claims.

BRIEF DESCRIPTION OF THE DRAWINGS

The invention is explained in more detail with reference to the drawing.

FIG. 10 shows a counting station with a differently designed transporting section, which moves packs of notes vertically upward past the counting device.

Figure 1:
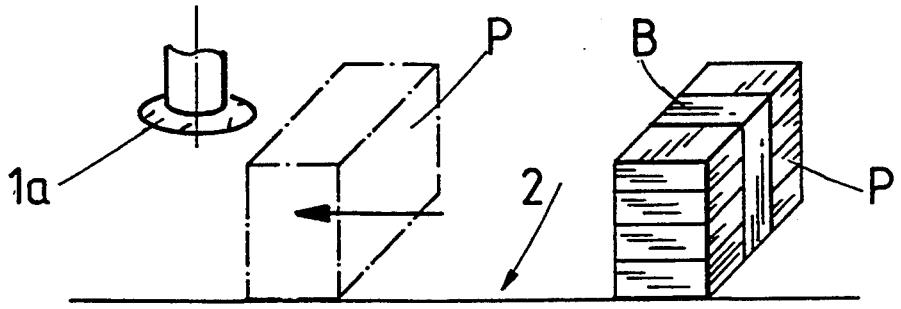
FIGS. 1 to 6 show, as already mentioned, the counting operation with a hitherto customary counting device according to the known prior art, FIG. 7 diagrammatically shows in perspective representation a counting station according to the invention within a transfer line for the packs of notes.
Figure 2:
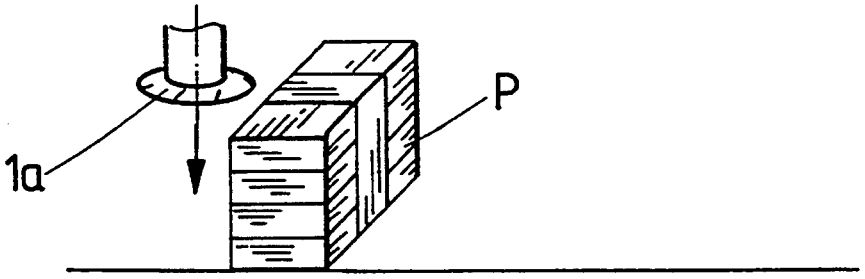
Figure 3:
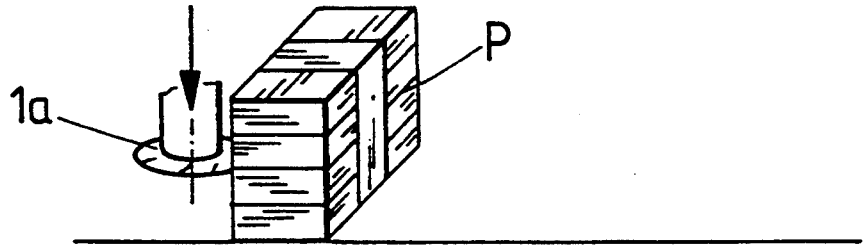
Figure 4:
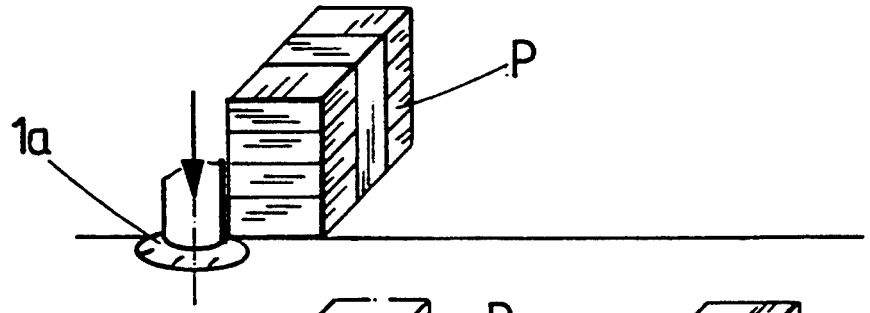
Figure 5:
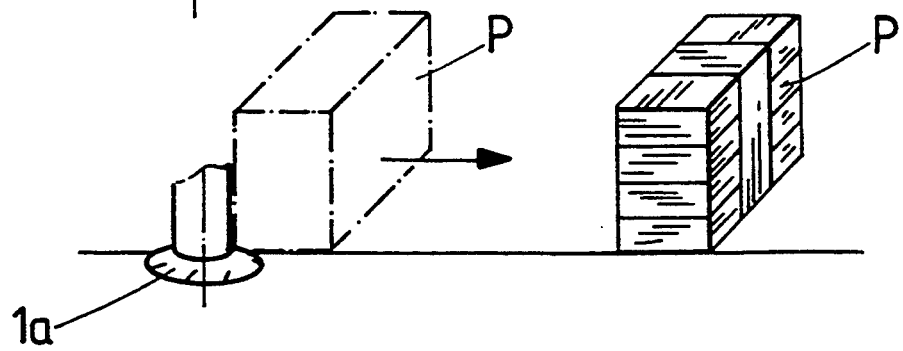
Figure 6:
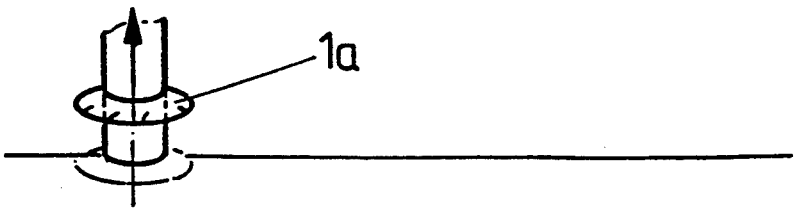

First of all, the known prior art is to be briefly explained once again with reference to FIGS. 1 to 6: according to FIG. 1, a pack of notes P on a transporting section 2 is moved in the direction of the arrow into a counting position under a counting device, of which only the rotating counting disk 1*a* is shown, and is held in this counting position. Then, the counting device with its counting disk 1*a* is moved vertically downward in the sense of the arrow according to FIG. 2, the counting disk leafing through the corners of the pack of notes as shown in FIG. 3 and, after ending the counting, assuming a position underneath the pack of notes P, as shown in FIG. 4. Subsequently, as shown in FIG. 5, the counted pack of notes P is advanced in the sense of the arrow and, as shown in FIG. 6, the counting device with its counting disk 1*a* is moved upward again into its starting position for counting the following pack of notes.

DESCRIPTION OF THE PREFERRED EMBODIMENT(S)

Figure 7:
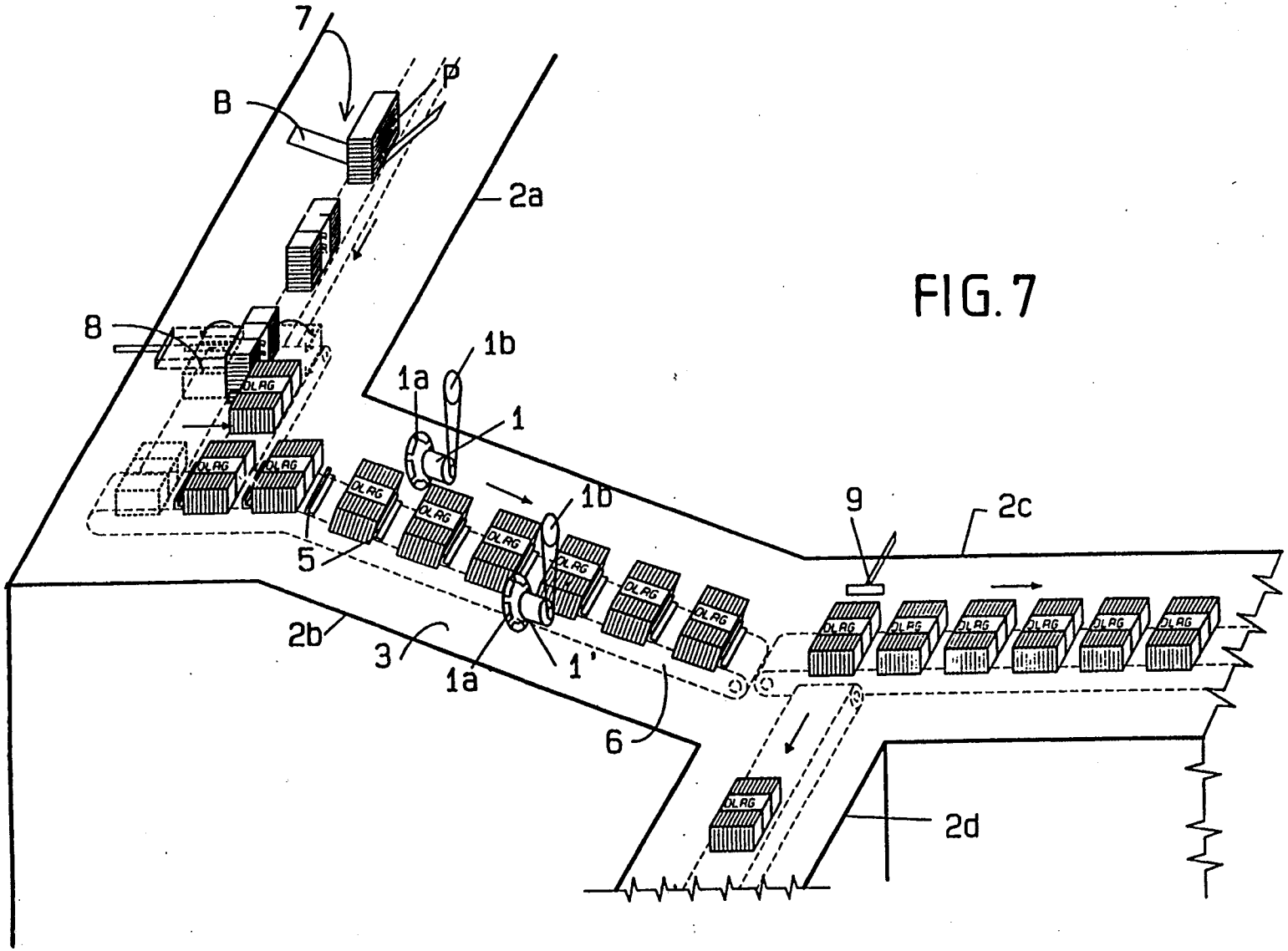

In comparison, the counting station according to the present invention is constructed as shown in FIG. 7, in which a part of a transfer line with the transporting sections 2*a*, 2*b*, 2*c* and 2*d* is shown, on which packs of notes P are moved in the sense of the arrows. The straight transporting section 2*b* belongs to the counting station which, in the example under consideration, has two counting devices 1 and 1′, which are arranged offset on the opposite sides of the transporting section. The transporting section 2*b* is equipped with a feed system which moves the packs of notes P at certain intervals from one another uniformally past the counting devices 1 and 1′.

Figure 8:
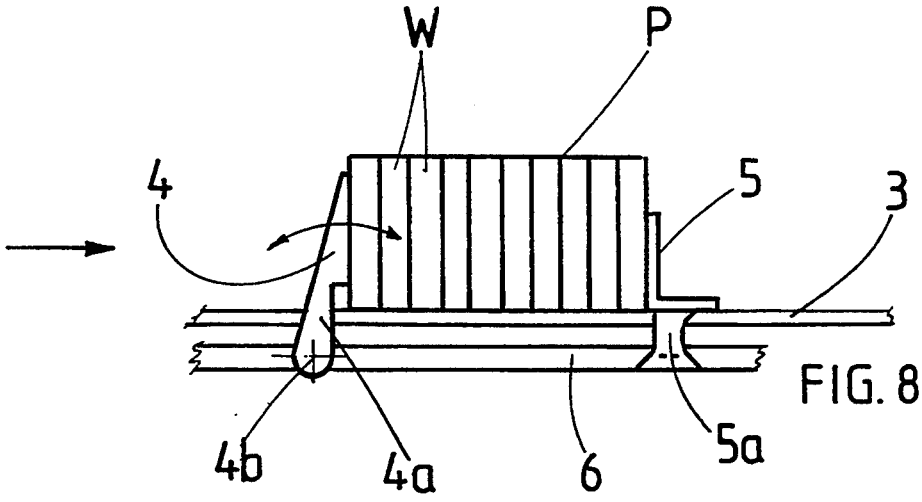
FIG. 8 shows a side view of a pack of notes advanced on a transporting support, said pack being pushed by a driver and bearing against a front stop.
Figure 9:
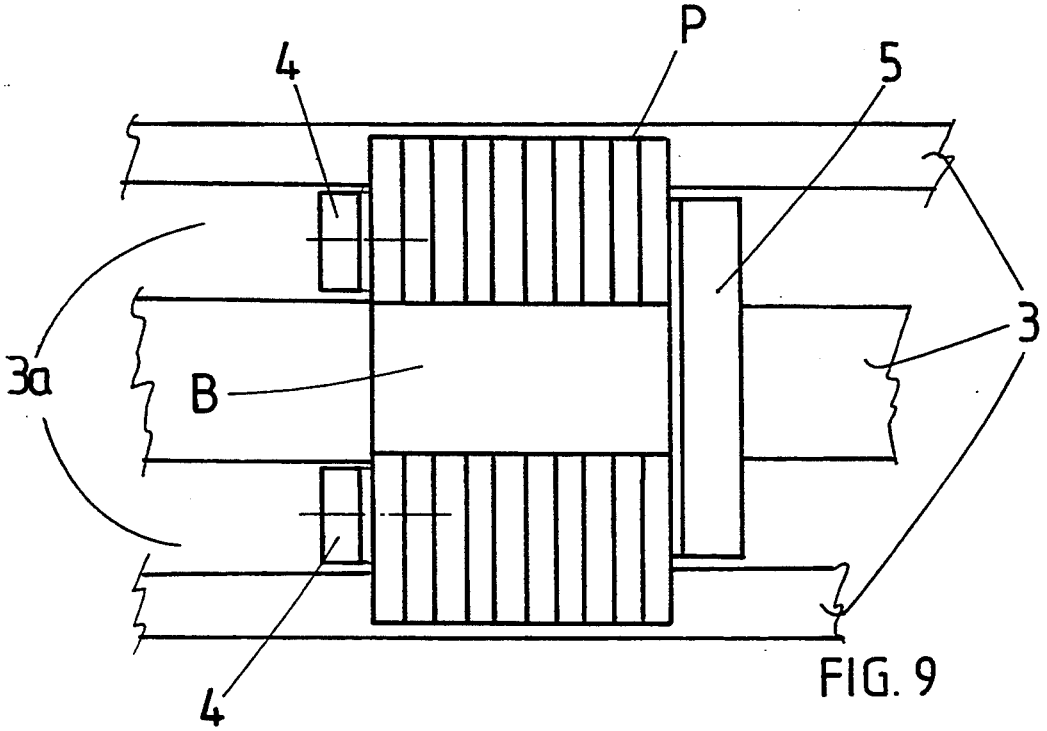
FIG. 9 shows a plan view of the pack of notes and the transporting support according to FIG. 8.

In the example under consideration, this feed system comprises an endless chain or belt conveyor 6 which runs under a fixed transporting support 3, and on which, as diagrammatically shown in FIGS. 8 and 9, drivers 4 and front stops 5 are fastened. The drivers 4, of which in each case two bear as pushing fingers against the rear edge of a pack of notes P, protrude with their lower section 4*a* through two parallel longitudinal grooves 3*a* of the transporting support 3 and are articulated on the endless conveyor 6 pivotally about the axis 4*b* in the sense of the double-head arrow. They are subject to the action of a spring (not shown) in such a way that they are prestressed in the transporting direction and can yield flexibly opposite to the transporting direction. The front stops 5 are borne by feet 5*a*, which likewise protrude through the longitudinal grooves 3*a* and are fastened on the conveyor 6.

Each pack of notes P comprises 10 banderoled bundles of notes W of 100 freshly printed notes of value each, thus contains altogether 1000 notes of value. The packs of notes P fed on the transporting section 2*a* in the sense of the arrows, in which the notes of value lie one on top of the other, are taken past an only diagrammatically indicated banderoling station 7 and are provided there with a banderole B. Subsequently, the packs of notes P are tilted by 90° at a tilting station 8, so that from then on the notes of value lie in upright position in the pack of notes, one behind the other in the transporting direction, on the transporting section. Depending on the pack edges at which it is desired to carry out one or more counts, the packs of notes P are tilted in the sense of one or the other curved arrow onto the one broad side or, as indicated by dot-dash lines, onto the other broad side.

Subsequently, the packs of notes P pass onto the transporting section 2*b*, which is oriented at right angles to the transporting section 2*a* and where they are taken over by the drivers 4, pressed against the respective front stops 5 and further moved on the transporting support 3. The individual notes of value in the packs lie upright on the longitudinal edge and transversely to the transporting direction. The two counting devices 1 and 1′ stationarily installed on the transporting section 2*b* are installed with their rotating counting disks 1*a* and 1*a*′ which are driven by drivewheels 1*b* and 1*b*′, respectively, and corresponding belts, in such a way that the packs of notes P moved with uniform speed are taken past the counting rim of the counting disk 1*a* or 1*a*′, while this counting disk leafs through the corners of the individual notes of value of each pack and counts as it does so. The axis of rotation of the counting disk lies approximately parallel to the transporting direction of the packs of notes, and the plane of the counting disk is therefore essentially vertically oriented. In order that the transporting speed of a pack of notes does not need to be synchronized exactly with the counting speed determined by the rotational speed of the rotating counting disk, that is with the speed at which the counting disk leafs through the pack, the drivers 4 are, as already mentioned, arranged flexibly yieldingly, so that the pack of notes P can, if appropriate, yield flexibly somewhat.

The feed system of the transporting section 2*b* may also be differently designed; all that is important is that the packs of notes are moved uniformly and the one corners of the notes of value are freely accessible for the counting device.

In the example under consideration, according to a preferred embodiment, the transporting support 3 of the transporting section 2*b* is inclined forward, so that the pushing-forward movement is promoted by the force of gravitation and the packs of notes P are taken sliding on a sloping plane through the counting rim of the counting disk.

In the example under consideration, moreover, each pack of notes P is counted twice in succession at different corners on the same transporting section, there thus takes place for reasons of security a so-called redundancy count. In principle a single count with only one counting device may also be adequate.

After ending the counting, the packs of notes P pass onto a diverter 9, from which downstream transporting sections 2*c* and 2*d* branch off in different directions. All the packs of notes which have the correct number of notes of value are further moved on the transporting section 2*c* and pass to a packing station, while the other transporting section 2*d* takes up those packs of notes for which the counting gave an incorrect number of notes of value.

As indicated in FIG. 7, the transporting sections 2*a*, 2*c* and 2*d* may likewise be provided with belt or chain conveyors and drivers fastened thereto, or else with any other feed systems.

In a final processing apparatus with an output of 480,000 notes of value per hour and alternating operation with two machines, a total of, for example, 15 seconds are available for a counting operation, so that, given a secondary time of, for example, only 1 to 2 seconds, a counting time of 13 to 14 seconds is available for the counting of the 1000 notes of value of a pack, that is to say 70 to 80 notes of value per second.

In the exemplary embodiment of a counting station according to FIG. 10, the transporting section 12 on which the fixed-in-place counting device 1 is located is vertically oriented. The feed system, which moves the packs of notes vertically upward past the counting device 1, comprises an endless chain 16, which is provided with drivers 14 and circulates in the direction of the arrows on the outer circumference of a closed, ovally shaped rail 13. Each driver 14 has an angle piece 15 with a leg 15*a* oriented tangentially with respect to the rail 13 and a leg 15*b* oriented radially or at right angles thereto. The leg 15*a* is provided with two running rollers 17, which are mounted rotatably on the chain 16 and run on the rail 13. Instead of a chain 16, an endless belt may also be provided.

On each angle piece 15 there is fastened an outwardly open receiving compartment 18 for receiving a banderoled pack of notes P, which in the example under consideration in each case contains 100 notes of value. The receiving compartment has two substantially parallel walls 19 and 20, which extend radially with respect to the rail 13 and of which the front wall 20, in the transporting direction, is somewhat shorter than the rear wall 19 and is bent away at its free end obliquely from this rear wall 19. The position of a pack of notes within a receiving compartment 18 during counting is defined by an inner stop 21, which is fastened on the wall 19 and against which the inner end of the pack of notes bears. In this counting position, the wall 19 thus forms the support for the pack of notes, which lies in the receiving compartment 18 with its notes of value oriented horizontally and the outer end region of which is not covered by the shorter wall 20.

In order to ensure a correct guidance of the drivers 14 with their receiving compartments 18 in the vertical upward movement along the transporting section 12, that is to say when counting, there is provided parallel to the vertical section 13*a* of the guide rail 13 a vertical directing rail 22, in such a way that the rollers 17 are guided between the vertical section 13*a* of the rail 13 and the directing rail 22.

Figure 10A:
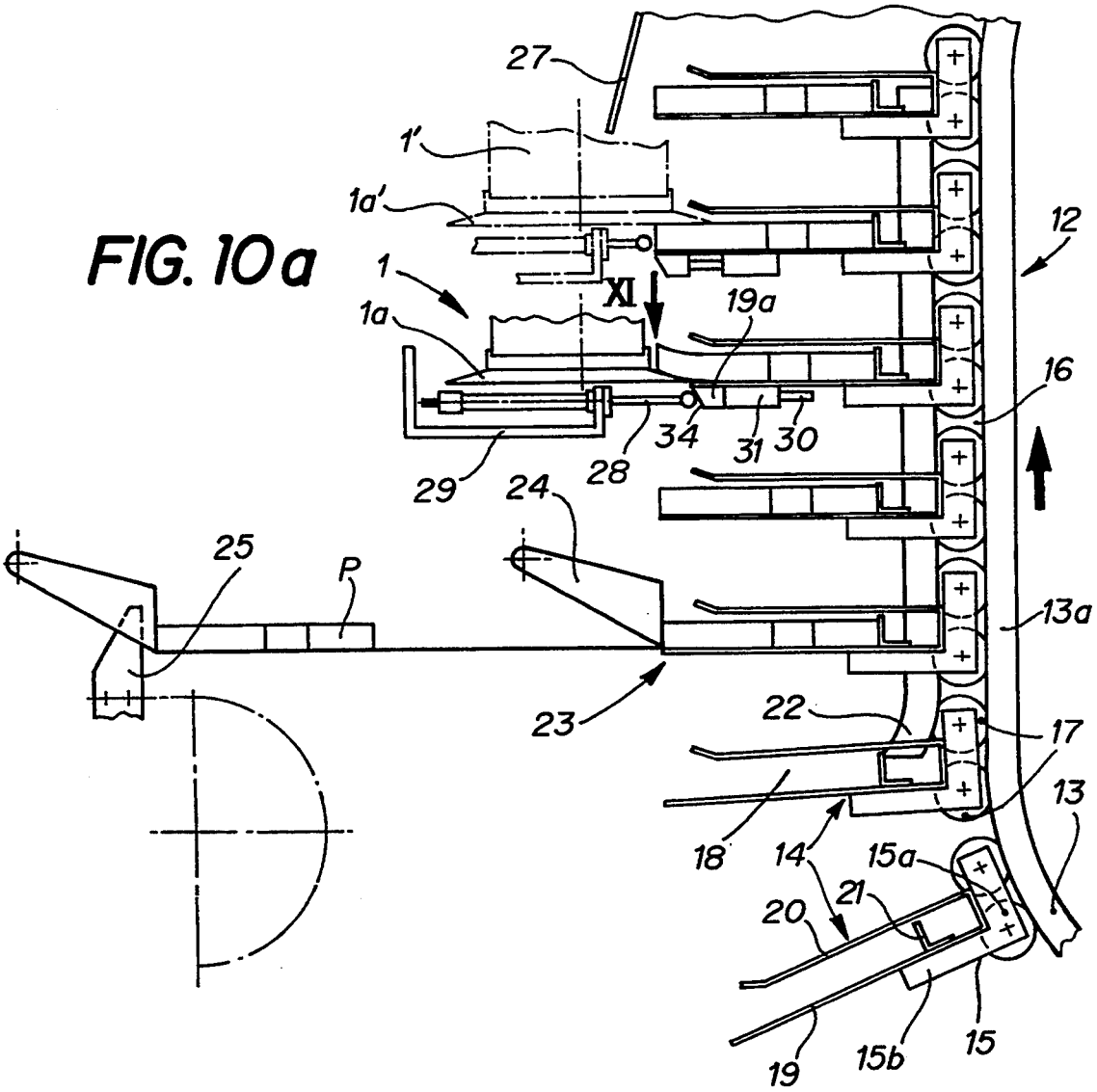
FIGS. 10*a* and 10*b* show on an enlarged scale the region of the counting station and also the station for removal of the counted packs of notes from the transporting section, and FIG. 11 diagrammatically shows a plan view of the counting station in the sense of the arrow XI according to FIG. 10*a*.
Figure 10B:
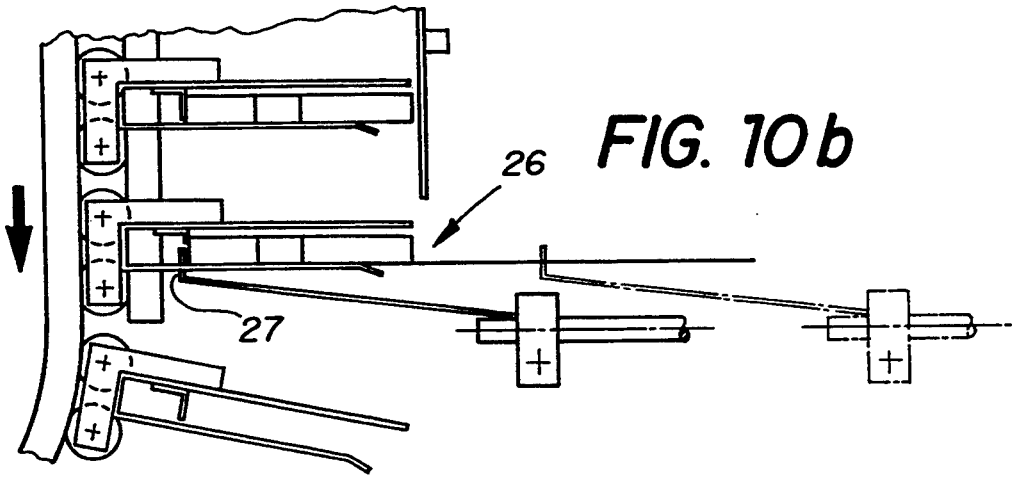

The banderoled packs of notes P arriving from the left, in the representation according to FIGS. 10 and 10*a*, on the transfer line in the horizontal direction, being transported by a transporting chain by means of pushing fingers 25, are taken over by a jointedly arranged slide 24, pushed further and pass onto the transporting section 12 at the input station 23. In this case, the arrangement is set up such that an upwardly moving receiving compartment 18 passing the input station 23 in each case takes over an incoming pack of notes, which is pushed by the slide 24 into this compartment until it makes contact with the stop 21. The successively arriving packs of notes pass one after the other into the following receiving compartments 18.

With their constant upward movement, one of the corners of the notes of value, lying vertically one on top of the other in the pack of notes, is counted upon passing the stationary counting device 1 by the counting disk 1*a* of the latter, the plane of which is oriented substantially horizontally. In the example under consideration according to FIGS. 10 and 10*a*, there is arranged, dot-dashed, above the counting device 1 and, offset perpendicularly with respect to the plane of the drawing, a further counting device 1', which counts the other outer corner of the notes of value of a pack of notes. After the counting, the packs of notes are further transported in their compartments along the guide rail 13, moved downward along the other vertical section of this rail 13, drawn out from the receiving compartment at the lower end of this vertical section, at the removal station 26 (FIG. 10*b*), by means of a pushing finger 27 and further transported on the transfer line. A securing plate 27, surrounding the outer ends of the receiving compartments at a small distance, prevents possible slipping out of the packs of notes from their receiving compartments during transporting to the removal station 26.

In the example under consideration, the walls 19 of the receiving compartments 18 are so long that a pack of notes passing the transporting section 12 rests over its entire length on this wall 19 and, consequently, the corner region of the pack of notes registered by the counting device is supported from below during counting, which is advantageous for satisfactory counting. In order that, after counting the bottom, final note of value of a pack of notes, the wall 19 can then pass the counting disk 1*a* of the counting device 1 freely, the corner region of the wall 19 covered by the counting disk 1*a* is designed, as illustrated in FIG. 11, as a displaceable corner piece 19*a*, which can be displaced against the action of a spring 32 by means of a guide pin 30 in a guide 31 attached on the underside of the wall 19, to be precise it can be displaced in the direction of the interior of the receiving compartment, that is to say to the right in the representation according to FIG. 11. For this purpose, on the relevant side of the wall 19 there is provided a cutout 33, in which the corner piece 19*a* engages in the pushed-in position. It should be noted that the walls 19 of all the receiving compartments 18 are provided in this way with a displaceable corner piece 19*a* and a guide 30, 31, 32, which, however, for reasons of simplicity, is represented in FIGS. 10 and 10*a* only for the receiving compartments 18 which are just passing the counting disks 1*a* and 1*a'*, respectively, of the counting devices.

In order to push back the corner piece 19*a* on the wall 19 at the correct point in time, there is provided directly underneath the counting device 1 a push rod 28 (FIG. 10*a*), which can be longitudinally displaced in a fixed-in-place guide 29 and is automatically actuated such that it temporarily pushes back the corner piece 19*a* immediately after completion of the counting of all the notes of value of a pack of notes, so that said corner piece lies in the cutout 33 according to FIG. 11 and consequently can pass unhindered the counting disk 1*a*. For this purpose, the push rod 28 presses against a beveled end face 34 of the corner piece 19*a*, which is held by the push rod 28 in the pushed-back position on account of the dimension of this end face in the transporting direction until it has been moved past the counting disk 1*a*. Then, the corner piece 19*a* is pressed back again under the action of the spring 32 into its normal position, shown in FIG. 11, and the push rod 28 is also drawn back. The operation described above is repeated upon passing each receiving compartment. If there is a second fixed-in-place counting device 1', there is of course provided an identical sliding mechanism, as described above, and the other outer corner region of each wall 19 is designed as a displaceable corner piece.

The movement of the endless chain 16 with its receiving compartments and the back and forth movement of the push rod 28 are, of course, synchronized such that the corner pieces 19*a* are pressed back at the correct point in time. In this case, the chain 16 can circulate continuously or else be controlled intermittently, so that it stops briefly after completion of the counting of a pack of notes, while the push rod 28 displaces the relevant corner piece 19*a*.

The counting station according to the invention is not restricted to the exemplary embodiments described but allows many different variants with regard to the design and arrangement of the transporting sections and of the feed systems.

I claim:

1. A counting station for counting the notes of value, in particular banknotes, of banderoled packs of notes P in a processing apparatus for freshly printed notes of value, having at least one automatically operating counting device (1, 1') with rotating counting disk (**1*a*, 1*a'*) and with a transporting section for the packs of notes, wherein the counting device (1, 1') with its counting disk (1*a*, 1*a'*) is arranged stationarily on the transporting section (2*b*, 12) and this transporting section is equipped with a feed system (4, 5, 6; 16, 18) moving the packs of notes at certain intervals from one another uniformally past the counting disk (1*a*, 1*a'***) whereby the banknotes of each pack are counted by the counting device as the packs move on the feed system past the counting disc.

2. The counting station as claimed in claim 1, wherein the feed system has drivers (4; 14) arranged at the same intervals from one another.

3. The counting station as claimed in claim 2, wherein the drivers (4) are flexibly yielding opposite to the transporting direction of the packs of notes (P).

4. The counting station as claimed in claim 1, wherein the feed system has front stops (5) for the packs of notes (P).

5. The counting station as claimed in claim 4, wherein the drivers (4) and, if provided, the front stops (5) are attached on a belt or chain conveyor (6) running underneath a fixed transporting support (3) and protrude through longitudinal grooves (**3*a***) of the transporting support.

6. The counting station as claimed in claim 1, wherein the mentioned transporting section (**2*b*) on which the counting device (1, 1'**) is fastened is inclined sloping downward in the transporting direction.

7. The counting station as claimed in claim 1, wherein there are arranged on the mentioned transporting section (**2*b*; 12) two counting devices (1, 1'**), which are arranged offset in the transporting direction and perform the counting at different corners of each pack of notes (P).

8. A counting station for counting the notes of value, in particular banknotes, of banderoled packs of notes P in a processing apparatus for freshly printed notes of value, having at least one automatically operating counting device (1, 1') with rotating counting disk (**1*a*, 1*a'*) and with a transporting section for the packs of notes, wherein the counting device (1, 1') with its counting disk (1*a*, 1*a'*) is arranged stationarily on the transporting section (2*b*, 12) and this transporting section is equipped with a feed system (4, 5, 6; 16, 18) moving the packs of notes at certain intervals from one another uniformally past the counting disk (1*a*, 1*a'*) the mentioned transporting section (12) being oriented substantially vertically and the feed mechanism has laterally open receiving compartments (18) and being set up for the purpose of moving the packs of notes (P), with their notes of value lying one on top of the other, upward past the counting device (1, 1'), the plane of the counting disk (1*a*, 1*a'***) being oriented substantially horizontally.

9. The counting station as claimed in claim 8, wherein the feed system has a closed belt or chain conveyor (16) which runs along an ovally shaped closed guide rail (13), oriented with its longitudinal axis substantially vertical, and on which the receiving compartments (18) are fastened such that they protrude radially, one of the vertical sections (**13*a*) forming the transporting section (12) provided with at least one counting device (1**).

10. The counting station as claimed in claim 9, wherein the receiving compartments (18) have a rear wall (19), seen in the transporting direction, which is adapted to the overall bearing surface of a pack of notes and is provided in that corner region on which the note corner to be counted rests with an inwardly displaceable corner piece (**19*a*), which can be pushed back by a push rod (28) on passing the counting disk (1*a*, 1*a'***).

11. A counting station for counting the notes of value, in particular banknotes, of banderoled packs of notes P in a processing apparatus for freshly printed notes of value, having at least one automatically operating counting device (1, 1') with rotating counting disk (**1*a'*, 1*a'*) and with a transporting section for the packs of notes, wherein the counting device (1, 1') with its counting disk (1*a*, 1*a'*) is arranged stationarily on the transporting section (2*b*, 12) and this transporting section is equipped with a feed system (4, 5, 6; 16, 18) moving the packs of notes at certain intervals from one another uniformally past the counting disk (1*a'*, 1*a'*) being arranged downstream of the mentioned transporting section (2*b*) a diverter (9) with two branching-off further transporting sections (2*c*, 2*d*), of which the one transporting section (2*c*) being set up for receiving packs of notes having a correct number of notes of value and the other transporting section (2*d***) being set up for receiving packs of notes having an incorrect number of notes of value.

* * * * *